US006496090B1

(12) United States Patent
Nishida et al.

(10) Patent No.: US 6,496,090 B1
(45) Date of Patent: Dec. 17, 2002

(54) ELECTRIC DEVICE SEALING STRUCTURE

(75) Inventors: Takeshi Nishida; Takashi Asao; Jiro Kumagae; Masanori Nakamura, all of Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/559,400

(22) Filed: Apr. 26, 2000

(30) Foreign Application Priority Data

Apr. 28, 1999 (JP) ..... 11-121698

(51) Int. Cl.[7] ..... H01H 9/02

(52) U.S. Cl. ..... 335/202; 335/128; 335/129; 335/83

(58) Field of Search ..... 335/78–86, 124, 335/128–31, 202

(56) References Cited

U.S. PATENT DOCUMENTS 5,293,002 A * 3/1994 Grenet et al. ..... 174/52.2
5,539,364 A * 7/1996 Mader ..... 335/128

FOREIGN PATENT DOCUMENTS

JP 58-65617 * 4/1983
JP 62-240521 * 10/1987
JP 6-182857 * 7/1994
JP 8-23054 * 1/1996

* cited by examiner

*Primary Examiner*—Lincoln Donovan

(57) ABSTRACT

Casing 5 is formed with a recess 67 toward an internal space in which the internal components are not located. The recess 67 is formed with a gate portion 69 as a resin inlet for forming the casing 5, and a bleeder portion 68 which is opened during a sealing operation and then sealed.

2 Claims, 9 Drawing Sheets

(Prior Art)

ELECTRIC DEVICE SEALING STRUCTURE

BACKGROUND OF THE INVENTION

The present invention relates to electric devices, and ore particularly to an electric device sealing structure having a characteristic casing structure.

In a conventional electric device, there is an electromagnetic relay constructed, for example, by mounting various internal components such as an electromagnet and a contact segment on a base and then sealing the structure in a casing. In this type of electromagnetic relay, as shown in FIG. 14, a casing 100 is formed with a gate portion 101, a bleeder portion 102 and a vent portion 103. The gate portion 101 is formed for injection molding. The bleeder portion 102 is formed to discharge internal air that expanded when sealing the underside of the base. It should be noted that the bleeder portion 102 will be sealed shut to prevent cleaning water from entering the inside during a later cleaning operation. Furthermore, the vent portion provides communication between the inside and the outside of the electromagnetic relay during operation so as to improve the life of electric components. More specifically, such communication prevents problems such as the wearing of contacts due to the generation of an electric arc between the contacts or a rise in temperature upon making and breaking of the connection between the contacts.

The gate portion 101, bleeder portion 102 and vent portion 103 each have an independent function and hence are conventionally formed in the casing 100 at separate locations. More specifically, the gate portion 101 and the vent portion 103 are arranged side-by-side in a substantially central area of the top wall, while the bleeder portion 102 is located at a corner of the top wall. Because of this reason, the structure of a mold for forming the casing 100 is intricate. Such an intricate structure inhibits the smooth flow of resin, which leads to the occurrence of inconveniences such as a short shot. In particular, during heat sealing of the bleeder portion 102, which is located at a corner, it is necessary to hold the casing by a supporting jig or the like so as to prevent the casing from tilting, resulting in poor workability.

Accordingly, it is an object of the present invention to provide an electric device sealing structure which has a casing that is simple fabric with superior moldability and workability.

SUMMARY OF THE INVENTION

As means for solving the foregoing problems, the present invention provides an electric device sealing structure for sealing an electric device by covering a base carrying internal components with a casing, wherein the casing is formed with a recess toward an internal space in which none of the internal components are located, the recess is provided at its bottom with a gate portion as a resin inlet for forming the casing and with a bleeder portion which is open during a sealing operation and sealed later.

With this construction, the casing has a simplified structure, and the mold for forming the casing also has a simplified structure. This allows resin to flow smoothly in injection molding, thereby assuredly providing a casing of a desired configuration.

A vent portion which is open when the electric device is in use may be also provided at the bottom of the recess.

This feature not only allows the gate portion, the bleeder portion or the bent portion to be suitably located for their purposes, but also enables a compact arrangement of internal components within the casing, thereby reducing the size of the structure.

It is preferred that the electric device comprise an electromagnetic relay having internal components including an electromagnet portion comprising a coil winding around an iron core with an intervening spool and a yoke integrated therewith, an armature disposed on one side of the electromagnet portion, a movable contact segment and a fixed contact segment disposed on the other side, and a card disposed above the electromagnet portion for transmitting the rotation of the armature to the movable contact arm, the card being shaped as a substantially rectangular frame to define the internal space in which the recess can be accommodated.

With this feature, the internal space in which the recess is to be formed can assuredly be formed even if the casing is reduced in size as an internal surface of the casing is positioned near any internal component in the casing.

DETAILED DESCRIPTION OF THE PREFERRED EMBODIMENTS

Next, the embodiments according to the present invention will be described with reference to the accompanying drawings.

Figure 1:
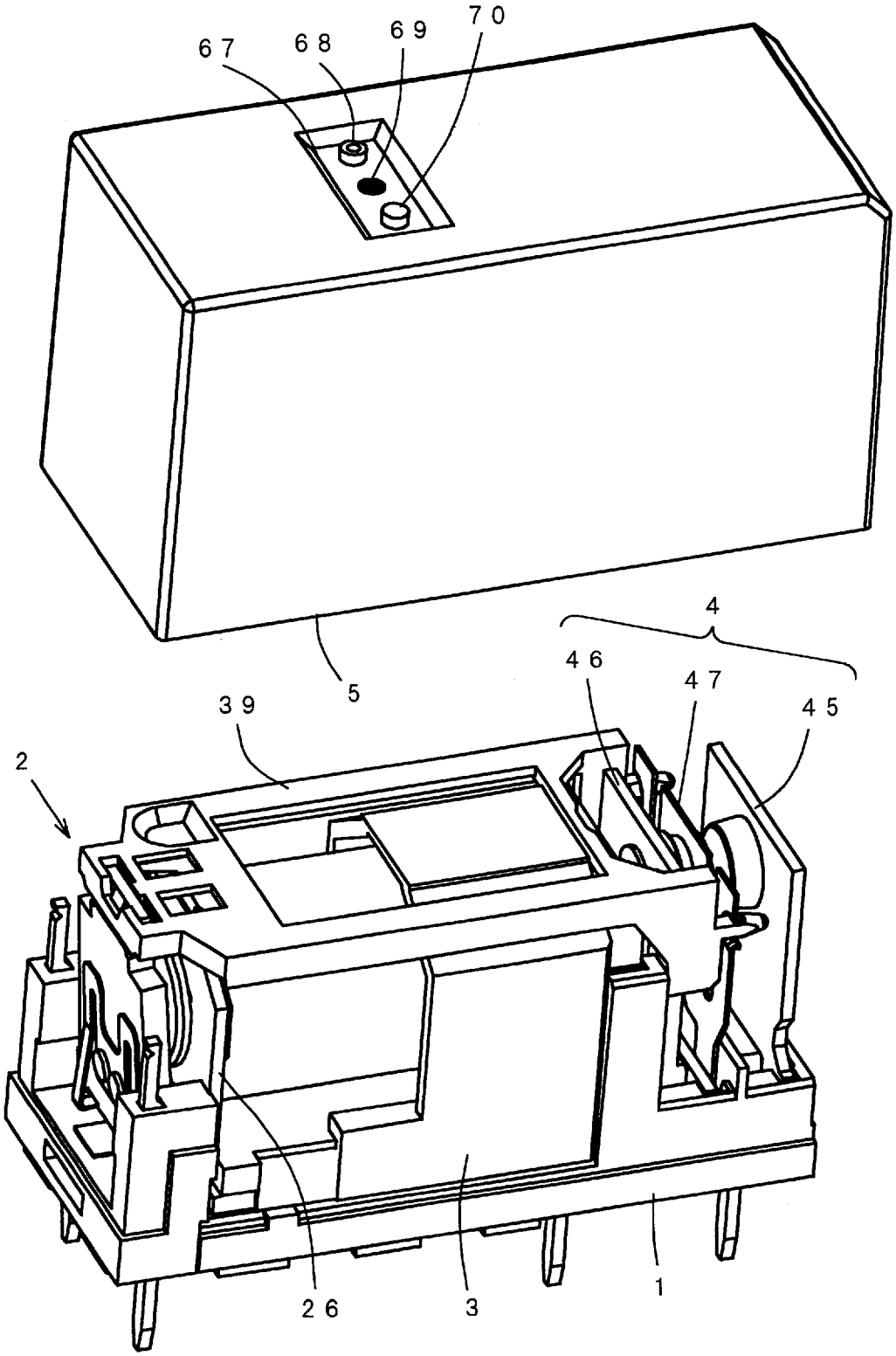
FIG. 1 is an exploded perspective view showing an electromagnetic relay and its casing according to the present invention.

FIG. 1 shows an exploded perspective view of the electromagnetic relay according to this embodiment.

This electromagnetic relay is constructed essentially of a base 1, and an electromagnet block 2, an insulating member 3, a contact segment 4 and a casing 5 which are mounted on the base 1.

Figure 2:
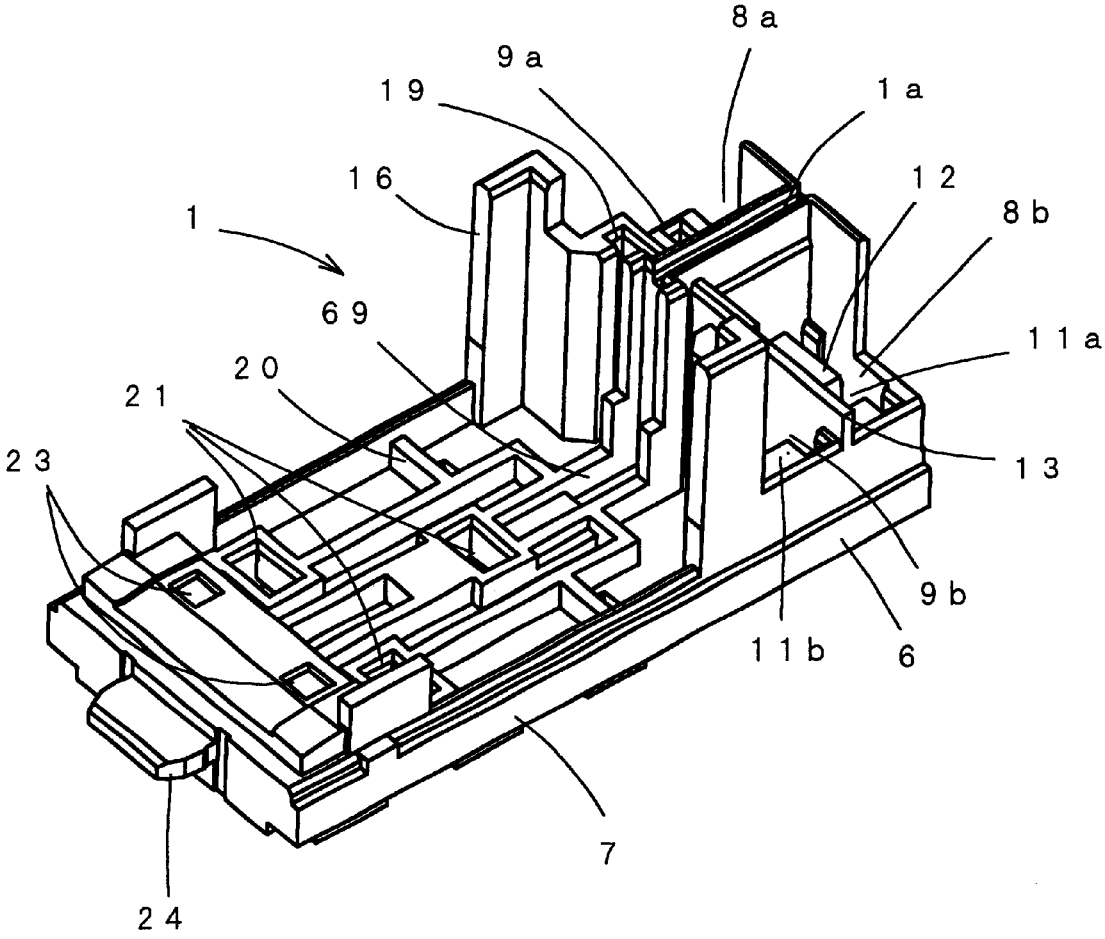
FIG. 2 is a perspective view showing a base of the electromagnetic relay shown in FIG. 1.

As shown in FIG. 2, the base 1 is in the form of a rectangular plate comprising a thick portion 6 and a thin portion 7. The thick portion 6 is partitioned in two widthwise by a partition wall 1*a* and formed with first force-fit receiving portions 8*a*,8*b* and second force-fit receiving portions 9*a*,9*b*.

Figure 3A:
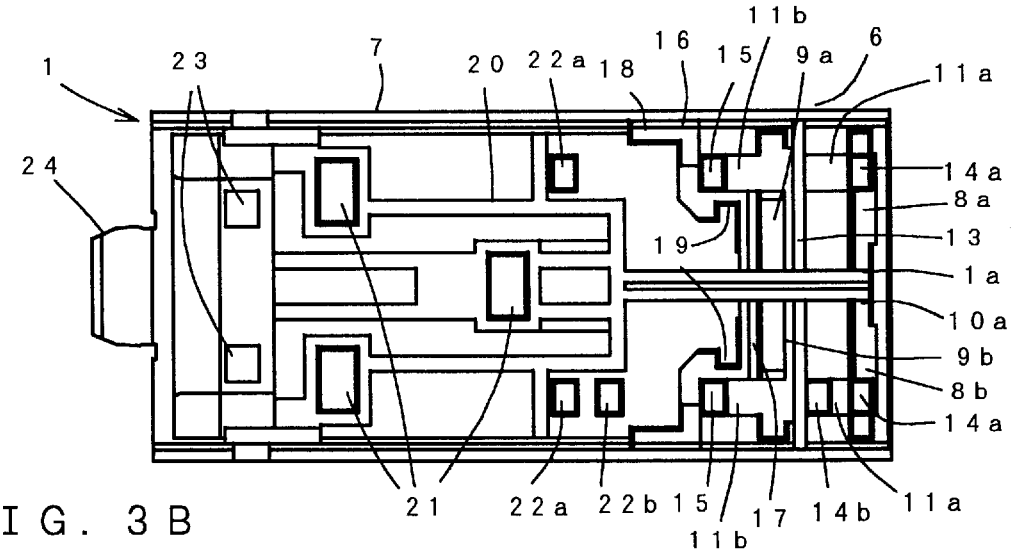
FIG. 3 is a plan view of FIG. 2.
Figure 3B:
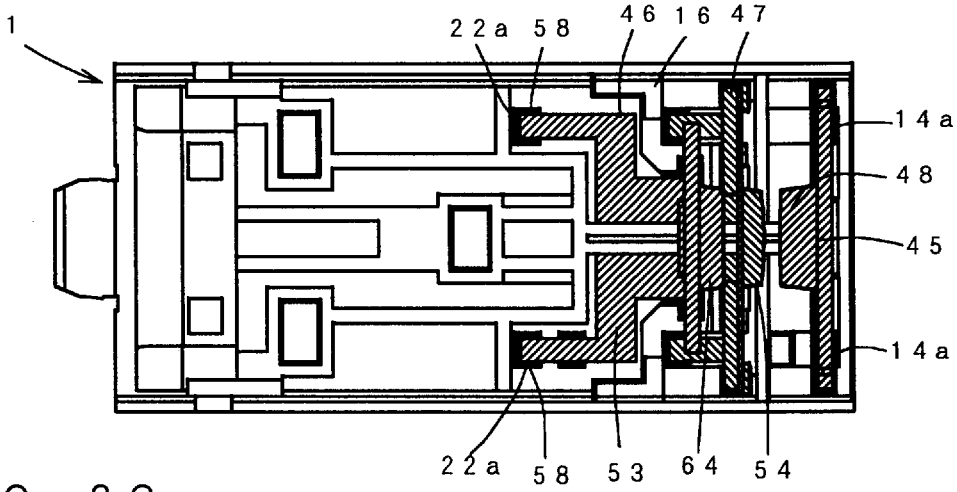
Figure 3C:
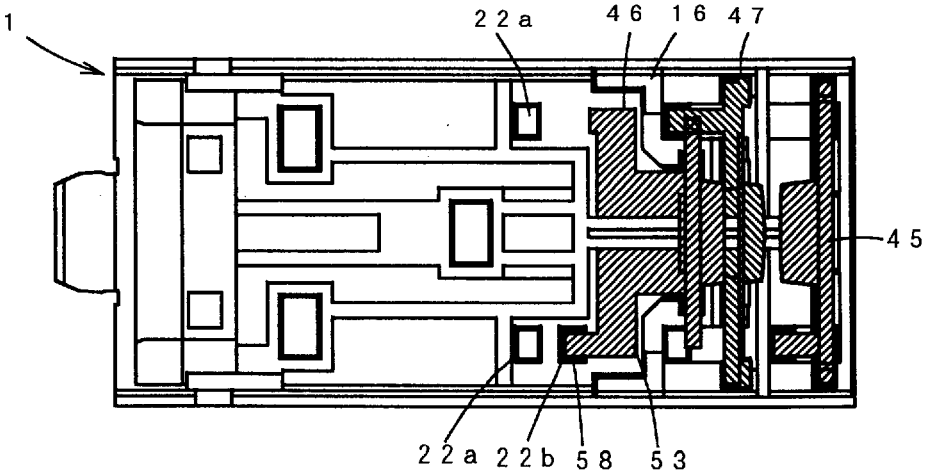

As shown in FIG. 3(*a*), opposite end portions of the first and second force-fit receiving portions 8*a*,8*b* and 9*a*,9*b* are adapted to receive respective force-fit projections 51*a*,51*b* and 57*a*,57*b* of the contact segments to be described later, which force-fit projections are to be forcibly fitted therein. Further, the force-fit receiving portions 8*a*,8*b* and 9*a*,9*b* are formed with relief recesses 11*a* and 11*b*, respectively, which extend toward the other end of the base 1. In the end portion at the bottom of each first force-fit receiving portion 8*a*,8*b* and the bottom portion of one of the relief recesses 11*a* are formed with first through-holes 14*a* and 14*b*, respectively, through which the respective terminal portions 52 of a fixed contact segment 45 are to be inserted. On the other hand, in the bottom of the relief recesses 11*b* of the second force-fit receiving portions 9*a*,9*b*, are formed second through-holes 15 for the respective terminal portions 60*a* of a movable contact segment 47 (to be described later) to be inserted therethrough.

The aforementioned thick portion 6 and the thin portion 7 of the base 1 are partitioned from each other by a third force-fit receiving portion 16. The third force-fit receiving portion 16 comprises contact segment receiving portions 17 each of which protrudes in a U-shaped fashion toward the thick portion 6, and guide portions 18 situated on opposite sides of the contact segment receiving portions 17 and in a L-shape protruding upward. In the contact segment receiving portions 17, opposite side walls 16 each have an internal surface formed by a force-fit groove 19 extending downwardly from an upper edge thereof. The guide portions 18 are adapted to guide an insulating member 3 (to be described later).

The thin portion 7 of the base 1 is reinforced by a rib 20 to prevent warping or the like, and formed with three rectangular force-fit holes 21 on the rib 20. On the thin portion 7 are formed two through-holes 22*a* and 22*b* one of which is adjacent to one of the guide portions 18 and the other through-hole adjacent to the other guide portion 18. Further, the thin portion 7 is formed with engaging recesses 23 in opposite upper portions adjacent to one end thereof and an engaging protrusion 24 on one end edge thereof.

Figure 4:
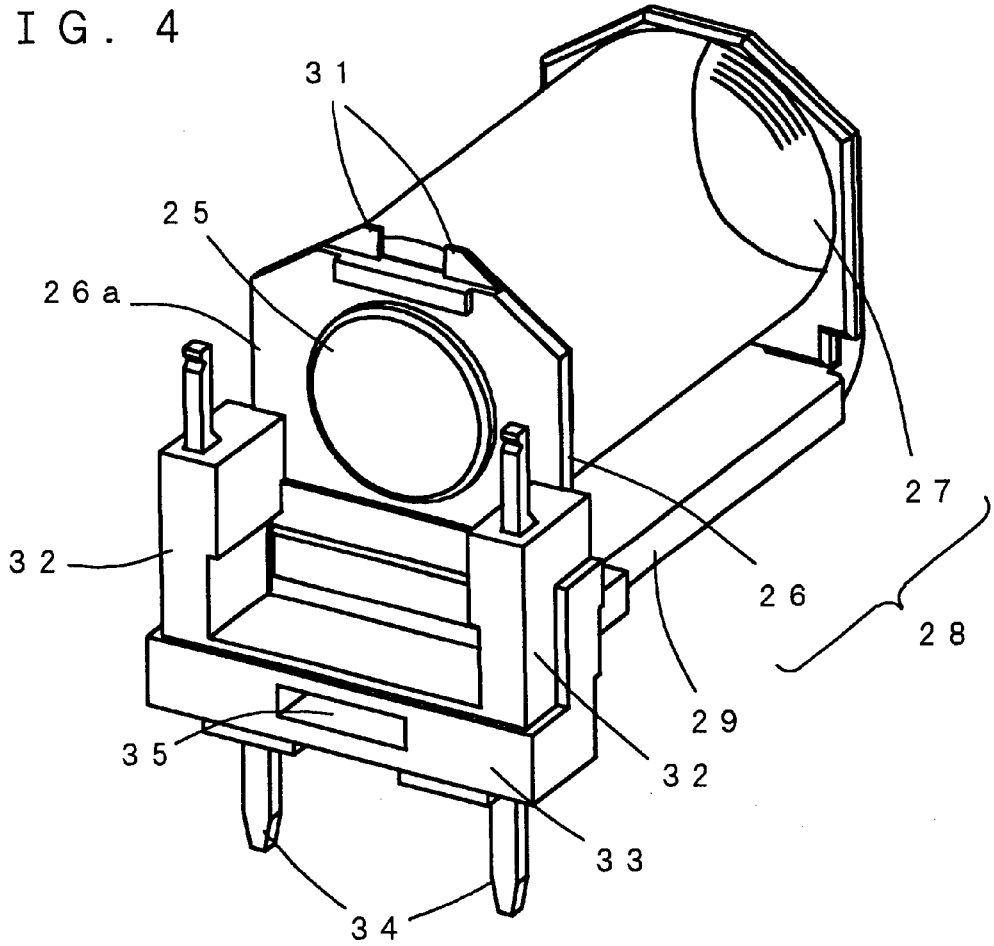
FIG. 4 is a perspective view showing the electromagnet block of the electromagnetic relay shown in FIG. 1.
Figure 5:
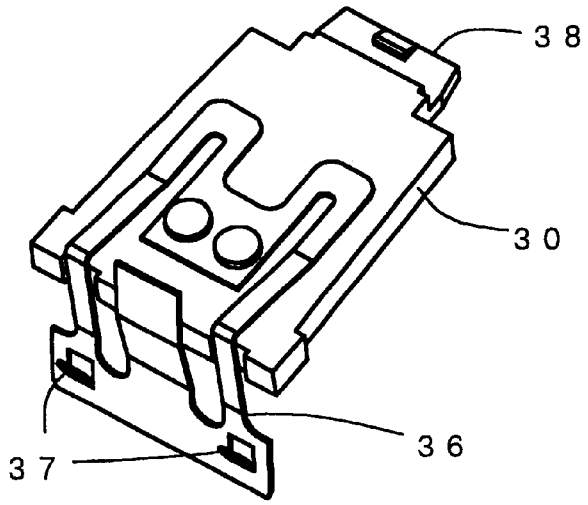
FIG. 5 is a perspective view showing the armature of the electromagnetic relay shown in FIG. 1.
Figure 6:
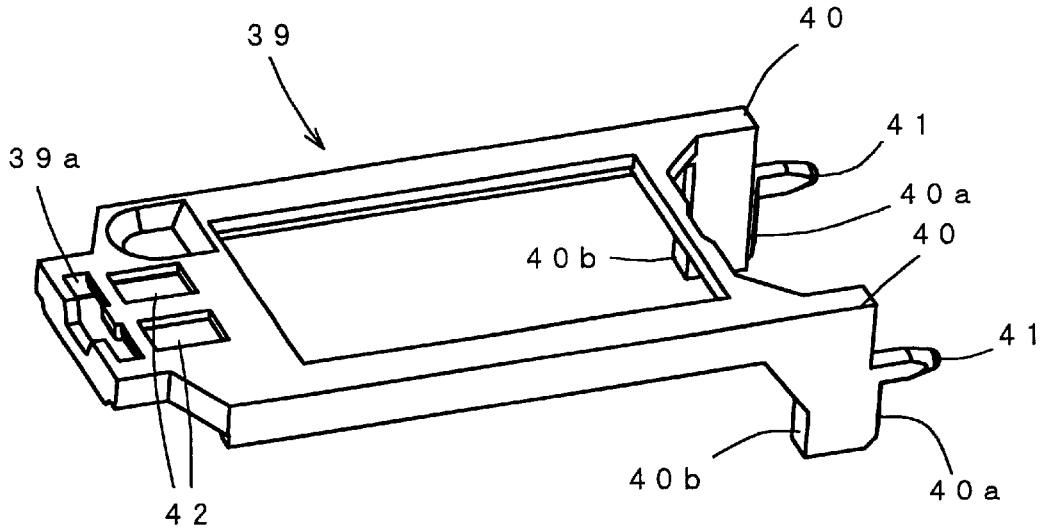
FIG. 6 is a perspective view showing the card of the electromagnetic relay shown in FIG. 1.

As shown in FIG. 4, the electromagnet block 2 comprises an electromagnet portion 28 having a coil 27 wound around an iron core 25 with an intervening spool 26, and a substantially L-shaped yoke 29 integrated therewith. On one side of the electromagnetic block 2 is disposed an armature 30 shown in FIG. 5. A pair of guide pieces 31 are formed by obliquely cutting opposite upper ends of one collar 26*a* of the spool 26 and providing a notch in a central portion of the collar 26*a*. Side walls 32 extend from opposite lateral edge of a lower half portion of one collar 26*a* and a bottom wall 33 extends from a lower edge of the collar 26*a* of the spool 26. Coil terminal portions 34 wrapped by both ends of the coil 27 are forcibly fitted into and integrated with the side wall 32. The bottom wall 33 is formed with an engaging hole 35 for engagement with the engaging protrusion 24 of the base 1. The armature 30 is unitized with a hinge spring 36 which is bent into a substantially L-shape. The hinge spring 36 has one end portion cut and raised to form hooking claws 37 to be inserted between the base 1 and the electromagnet block 2 to engage the engaging recesses 23. The armature 30 has an upper portion formed with an engaging portion 38 for engagement with one end of the card 39. As shown in FIG. 6, the card 39 is of a substantially frame-like shape and is formed with stoppers 40 extending from one side. The stoppers 40 each have an engaging projection 41 at the terminating end thereof. A portion below the engaging projection 41 protrudes further than above the engaging projection 41 to form a pressing portion 40*a*. Each stopper 40 has a stopper surface 40*b* which is adapted to abut a respective guide portion 18 for restricting the movable range of the card 39. The card 39 is formed with guide holes 42 for the positioning of the respective guide pieces 31 of the spool 26. The guide holes 42 enable stable motion of the card 39.

Figure 7:
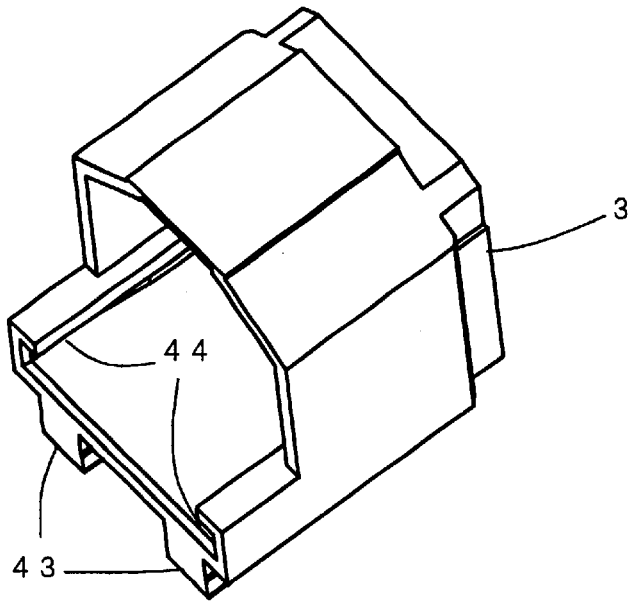
FIG. 7 is a perspective view showing the insulating member of the electromagnetic relay shown in FIG. 1.

As shown in FIG. 7, the insulating member 3 is cylindrically shaped having an opening on one side only and a bottom wall formed with force-fit projections 43 to be forcibly fitted into the force-fit holes 21 of the base 1. Guide grooves 44 are formed on opposite lower internal surfaces of side walls of the insulating member 3. The yoke 29 of the electromagnetic block 2 is to be force-fitted into the guide grooves 44.

As shown in FIG. 1, the contact segment 4 comprises the first and second fixed contact segments 45 and 46 and the movable contact segment 47, any one of which is of a unipolar type.

Figure 8A:
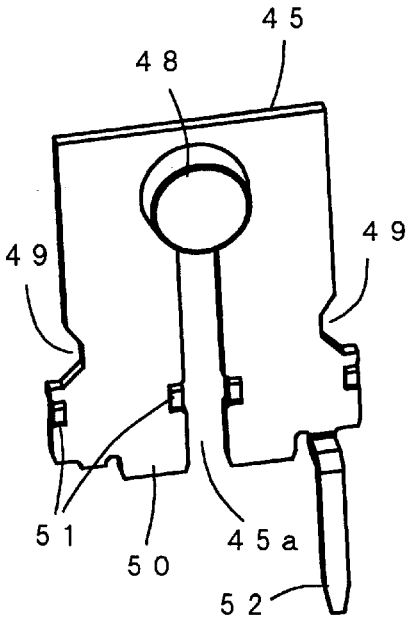
FIG. 8 is a perspective view showing the first fixed contact segment of the electromagnetic relay shown in FIG. 1.
Figure 8B:
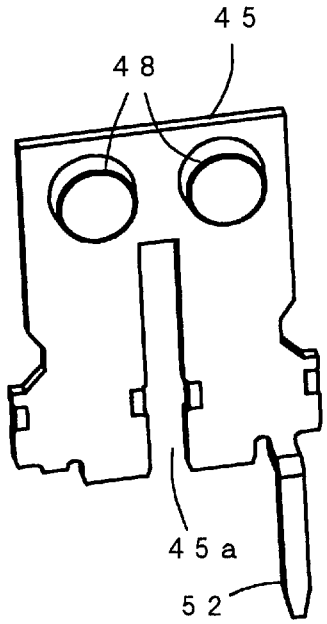
Figure 8C:
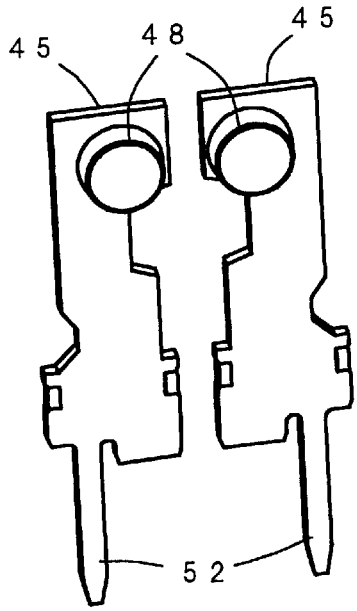

As shown in FIG. 8(*a*), the first fixed contact segment 45 is shaped into a substantially rectangular plate by pressing a conductive material. The first fixed contact segment 45 defines a notch 45*a* extending upwardly from a central portion of a lower edge thereof. This notch 45*a* serves to prevent interference between the first fixed contact segment 45 and the partition wall la of the base 1. To an upper portion of the first fixed contact segment 45 is securely fixed to a single first fixed contact 48. Further, the first fixed contact segment 45 is formed with notches 49 on opposite lateral edges thereof. Portions downwardly extending from the notches 49, which are wider than a portion upwardly extending therefrom, serve as first force-fit portions 50. The first force-fit portions 50 are each formed with first force-fit projections 51 projecting thicknesswise from opposite side edges and hence can be force-fitted into the corresponding first force-fit receiving portions 8*a*,8*b* of the base 1. A first terminal portion 52 projects from one lower end portion of the first contact segment 45 which is separated from the opposing segment by the notch 45*a*.

Figure 9A:
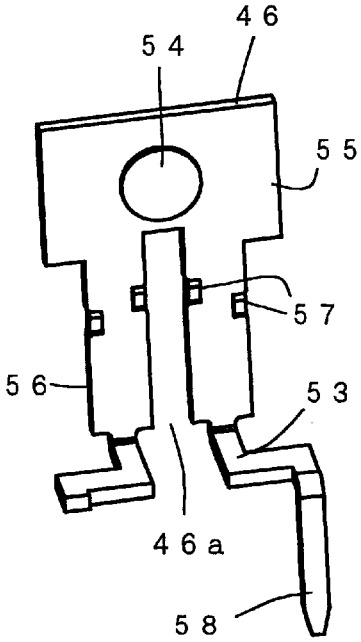
FIG. 9 is a perspective view showing the second fixed contact segment of the electromagnetic relay shown in FIG. 1.
Figure 9B:
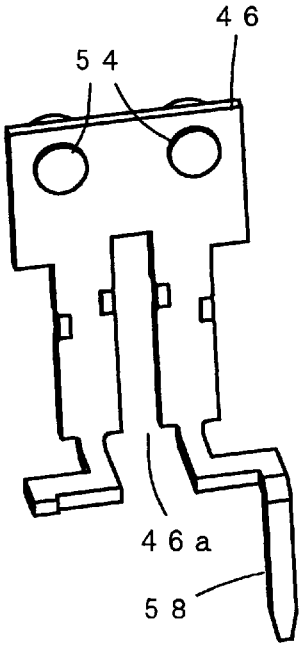
Figure 9C:
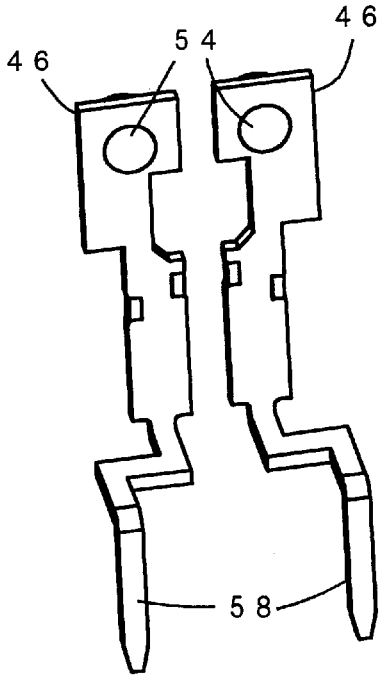

As shown in FIG. 9(*a*), the second fixed contact segment 46 is formed by pressing a conductive material and is bifurcated by providing a notch 46*a* extending centrally thereof. The lower end of each bifurcation is formed with a bent portion 53 which is bent substantially into a square. The upper portion of the second fixed contact segment 46 serves as a fixed contact portion 55 to which a second fixed contact 54 is securely fixed. Narrower portions situated under the fixed contact portion 55 serve as the second force-fit portions 56. The second force-fit portions 56 are each formed with second force-fit projections 57 projecting thicknesswise from upper portions of opposite side edges and hence can be force-fitted into the corresponding second force-fit receiving portions 9*a*,9*b* of the base 1. One of the bent portions 53 has a terminating end formed with a second terminal portion 58 extending substantially perpendicular therefrom, which is to be inserted downward through the second through-hole 15 of the base 1.

Figure 10A:
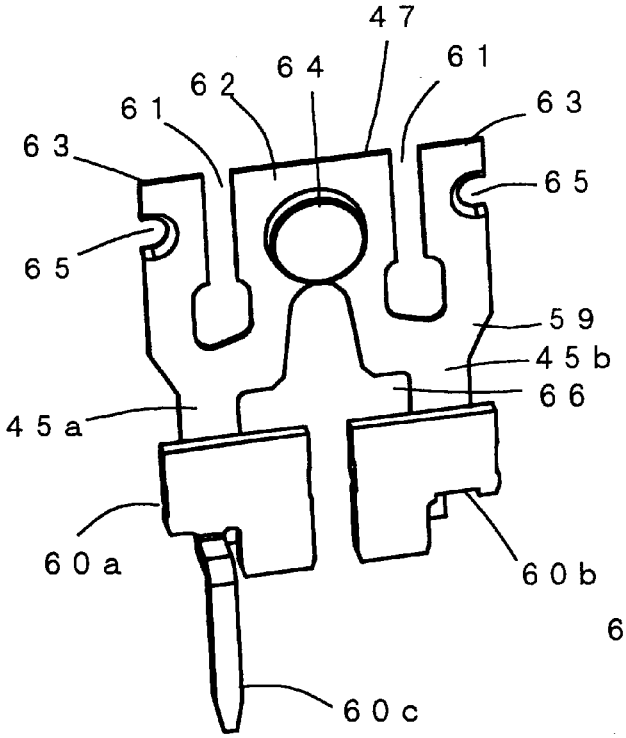
FIG. 10 is a perspective view showing the movable contact segment of the electromagnetic relay shown in FIG.
Figure 10B:
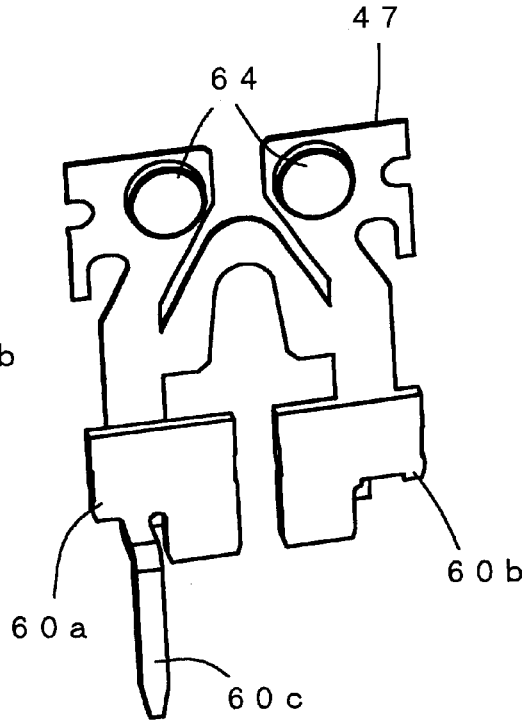
Figure 10C:
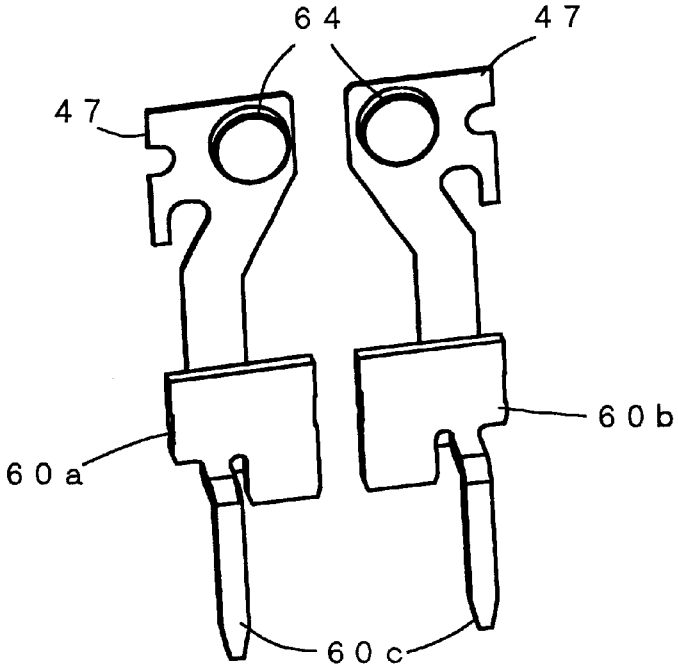

As shown in FIG. 10(*a*), the movable contact segment 47 comprises a plate-shaped contact segment portion 59 formed by pressing a conductive material, and terminal portions 60*a* and 60*b* formed integrally with the contact segment portion 59.

The upper half portion of the contact segment portion 59 is formed with a movable contact portion 62 and drive segments 63 on opposite sides of the movable contact portion 62 which are defined by cutout portions 61. Movable contacts 64 are securely fixed to the movable contact portion 62 so as to be positioned on opposite sides thereof. Each drive segment 63 is forced by a respective pressing portion 40*a* to move the contact segment portion 59. Each drive segment 63 is formed with a semicircular engaging portion 65 by cutting and raising which engages a respective engage projection 41 of the card 39. On the other hand, the lower half portion of the contact segment portion 59 is split into a pair of leg portions 45*a* and 45*b* by a central notch 66. By virtue of the cutout portions 61 and notch 66, the contact segment portion 59 can have a sufficient effective length to minimize the force required to drive the drive segments 63. Furthermore, the contact segment portion 59 can provide constant and stable operation by virtue of the right and left drive segments 63. The terminal portions 60*a* and 60*b* are securely fixed to respective leg portions 45*a* and 45*b* separated from each other by the notch 66. One terminal portion 60*a* is formed with a third terminal portion 60*c* to be inserted through the third through-hole 22*a* of the base 1.

It should be noted that each of the contact segments 4 may be of a unipolar type having twin contacts as shown in FIGS. 8(*b*), 9(*b*) and 10(*b*) or of a bipolar type divided into two as shown in FIGS. 8(*c*), 9(*c*) and 10(*c*), as well as of the foregoing unipolar type having a single contact. Any one of these contact segment types can be mounted on a base 1 with the completely same structure as described above. The two variations of the contact segment 4 are different from each other simply in that one is divided into two while the other is not divided, and hence they have the same configuration until the division is effected. Thus, it is possible that these two types of contact segment can be manufactured by using the same production line except the cutting-out and -off process which is the final process. This eliminates additional manufacturing cost for different types. Each of the aforementioned unipolar type contact segments may have a pair of terminal portions for higher power or a single terminal portion for lower power (refer to FIGS. 3(*b*) and (*c*)).

The casing 5, as shown in FIG. 1, is configured to be fitted over the outer peripheral edges of the base 1 and the collar of the spool 26 to cover the internal components. A rectangular recess 67 is formed in the top wall of the casing 5. This recess 67 is formed with a bleeder portion 68, a gate portion 69 and a vent portion 70. The bleeder portion 68 is cylindrical and is open when the underside of the base 1 is sealed. This is to avoid inconveniences caused by the expansion of internal air due to a rise in temperature during the sealing operation. The bleeder portion 68 can also be utilized in creating a vacuum in the electromagnetic relay or filling in the electromagnetic relay with an inert gas. After the completion of the sealing operation and like operations, the bleeder portion 68 is closed by heat sealing. The gate portion 69 is a resin inlet for injection molding and is formed at a substantially central location on the top wall convenient for molding. The vent portion cover element 70 is to be removed for communication between the inside and the outside of the structure when the electromagnetic relay is in use, whereby the life of electrical components of the relay can be extended. To remove the vent portion recover element 70 is not necessary for creating a vacuum on the inside or for filling the electromagnetic relay with an inert gas.

A process for assembling the electromagnetic relay is described below. Here, the electromagnetic relay is of the type for high power.

First, each contact segment 4 is fitted into a respective force-fit portion of the base 1. The first fixed contact segment 45 is mounted by force-fitting the first force-fit portions 50 (first force-fit projections 51) into the first force-fit receiving portions 8*a*,8*b* of the base 1 from above to insert the terminal portion 52 through the through-hole 14*b*. The second fixed contact segment 46 is mounted by force-fitting the second force-fit portions 56 (second force-fit projections 57) into the force-fit receiving grooves 19 of the third force-fit receiving portions 16 of the base 1 from above to insert the terminal portion 58 through the through-hole 22*b*. In this case the bent portion 53 is positioned in the thin portion 7 and does not protrude from the rib 20. The movable contact segment 47 is mounted by force-fitting the terminal portions 60*a*,60*b* into the second force-fit receiving portions 9*a*,9*b* of the base 1 from above to insert the terminal portion 60*c* through the through-hole 15. In this way, all the contact segments 4 can be mounted on the base 1 from above efficiently without changing the orientation of the base 1.

Figure 12:
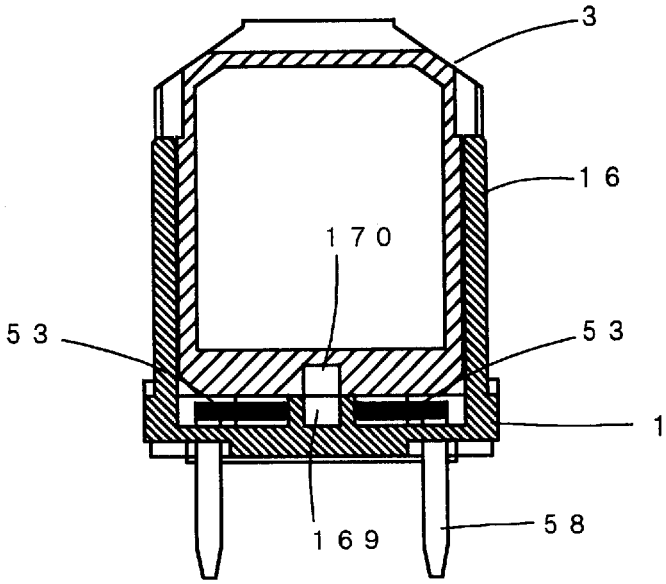
FIG. 12 is a sectional view of FIG. 11.
Figure 13A:
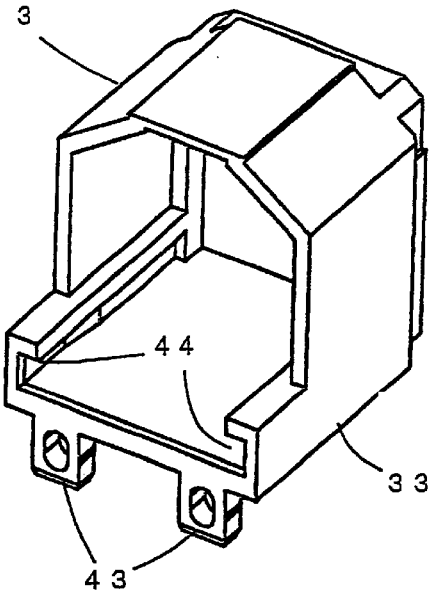
FIG. 13 is a perspective view showing the insulating member of the electromagnetic relay shown in FIG. 11.
Figure 13B:
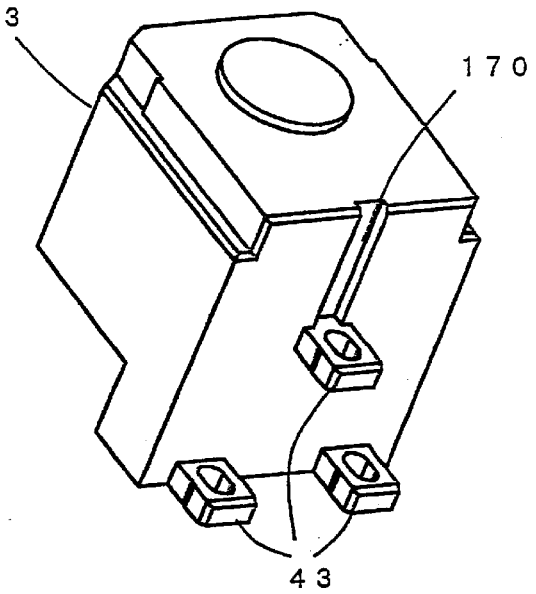
Figure 14:
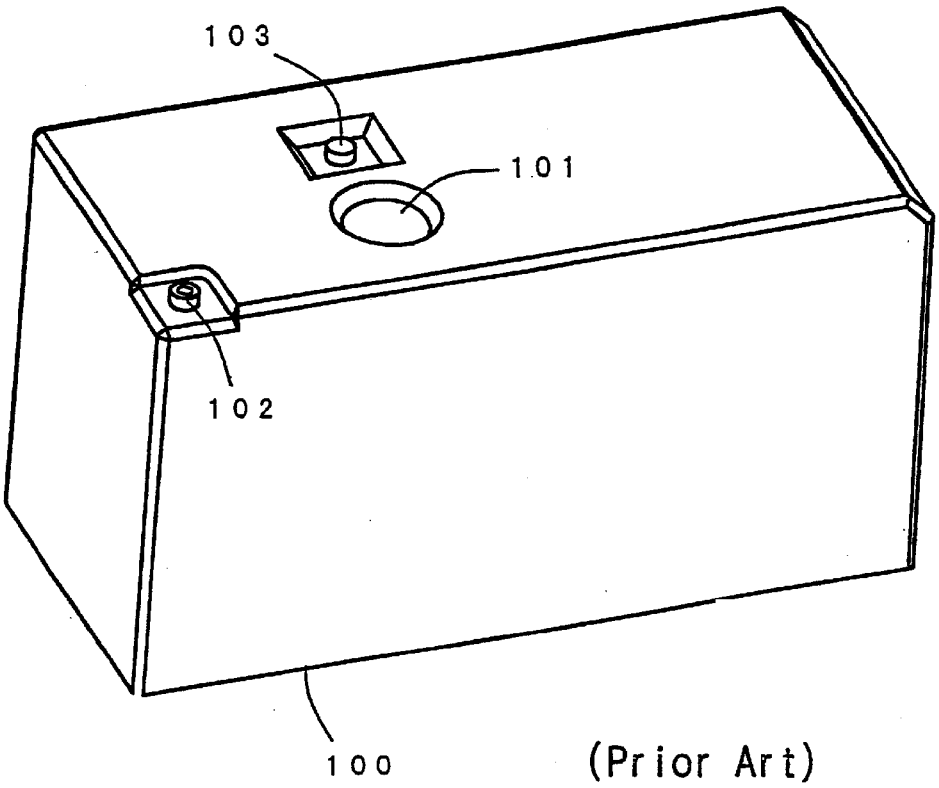
FIG. 14 is a perspective view showing a casing of a prior art electromagnetic relay.

After the mounting of the contact segments 4, the insulating member 3 is mounted on the base 1 as shown in FIG. 12. The insulating member 3 is fixed by guiding its one end edge portions with the guide portions 18 to force-fit the force-fit projections 43 into the force-fit holes 21. Thus, the bent portions 53 of the second fixed contact segment 46 can be completely covered by the insulating member 3 to allow the bent portions 52 to be located below the electromagnet block 2 with sufficient insulation maintained between the two.

Subsequently, the electromagnet block 2, which was previously assembled in a separate process is mounted on the base 1. The electromagnetic block 2 is mounted on one side of the base 1 so that one end portion thereof is accommodated in the insulating member 3. The electromagnet block 2 is fixed by force-fitting the opposite side edge portions of the yoke 29 into the guide grooves 44 of the insulating member 3 while making the engaging hole 35 of the spool 26 engage the engaging protrusion 24 of the base 1.

In turn, the armature 30 fitted with the hinge spring 36 is mounted on the base 1. The armature 30 is pivotally supported on the base 1 by inserting one end portion of the hinge spring 36 between the base 1 and the electromagnet block 2 and making the hooking claws 37 hook the engaging recesses 23 of the base 1.

Then, the armature 30 and the movable contact segment 47 are interconnected via the card 39. Since the movable range of the card 39 is restricted by the guide portions 18 of the base 1 in which the electromagnet block 2 is fitted, it impossible to keep the stroke constant of the movable contact 64 relative to the second fixed contact 54 accurately.

Finally, the casing 5 is fitted over the base 1 and a portion of the electromagnet block 2 to cover the internal components. The casing 5 is previously formed into a box-like shape with open bottom by injection molding. In this case, the bleeder portion 68, gate portion 69 and vent portion 70 are all formed in the recess on the top wall of the casing 5. For this reason, the structure of the mold for forming the casing 5 is simplified thereby allowing injected resin to flow smoothly. This reduces the number of defective products and hence improves the yield.

With the casing 5 fitted over the base 1, little clearance exists between the internal surface of the casing 5 and the internal components. In other words, the internal components each are disposed to fully utilize the limited and narrow internal space. Only the substantially rectangular card 39 disposed above the electromagnet block 2 provides a space in which the recess 67 in the top wall of the casing 5 can be accommodated.

The fitting portion between the underside of the base 1 and the casing 5 is sealed by immersion in a molten sealing compound. In this case, the bleeder portion 68 formed in the recess 67 of the casing 5 is open. Thus, expanded internal air is discharged to the outside to avoid inconveniences which would otherwise occur due to an elevated internal pressure. This ensures firm sealing of the fitting portion and like portions with the sealing compound.

When the sealing operation is completed and the temperature drops, the bleeder portion 68 is closed by heat sealing to complete the electromagnetic relay. Depending on the application of the electromagnetic relay, an inert gas may be filled into the internal space or a vacuum may be provided in the internal space. The vent portion cover element 70 is removed from the electromagnetic relay as thus completed to provide communication between the inside and the outside when the relay is to be used. The removal of the vent portion cover element 70 allows carbides and oxides produced by arc generated upon making and breaking of connections between the contacts to be discharged to the outside. In addition, a rise in temperature due to making and breaking of connections between the contacts can be suppressed thereby mitigating degradation in coil performance. Consequently, the life time of the electrical components of the electromagnetic relay can be extended.

The aforementioned electromagnetic relay operates as follows.

When the electromagnet portion 28 is not energized, the armature 30 biases the movable contact segment 47 through the card 39 by means of the hinge spring 36 to make contact between the movable contact 64 and the second fixed contact 54 of the second fixed contact segment 46. In this situation, since the movable range of the card 39 is restricted by the guide portions 18 of the base 1 as described above, the stroke of the movable contact 64 relative to the second fixed contact 54 is maintained constant to ensure a desirable contact reliability.

When the electromagnet portion 28 is energized, the armature 30 pivots because of its attraction-to the end portion of the iron core 25 causing the movable contact segment 47 to be deflected toward the first fixed contact segment 45 via the card 39. This causes the movable contact 64 to come apart. from the second fixed contact 54 and make contact with the first fixed contact 48 of the first fixed contact segment 45.

In the foregoing embodiment, the contact segment 4 of the unipolar type having a single contact as shown in FIGS. 8(*a*), 9(*a*) and 10(*a*) is mounted on the base, it is possible that the contact segment 4 of the single-pole type having twin contacts as shown in FIGS. 8(*b*), 9(*b*) and 10(*b*) is mounted on the base. Alternatively, the contact segment 4 as shown in FIGS. 8(*c*), 9(*c*) and 10(*c*) can be mounted on the base to provide an electromagnetic relay of the bipolar type as shown in FIG. 11.

Figure 11:
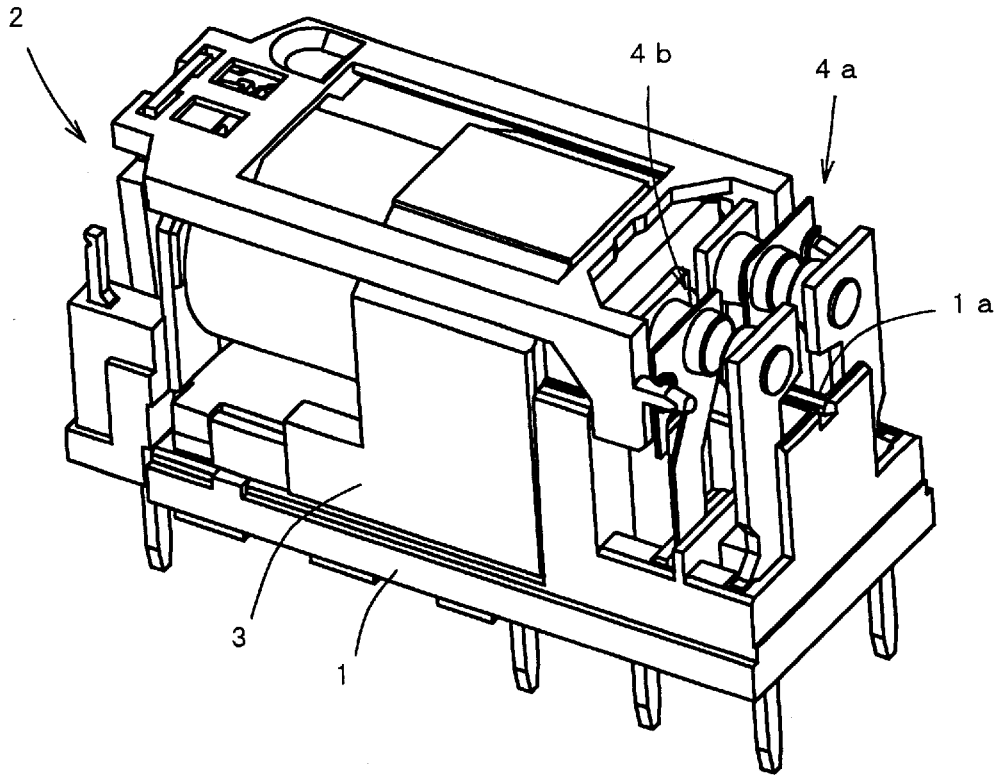
FIG. 11 is a perspective view showing an electromagnetic relay according to another embodiment.

In the case of the electromagnetic relay of the bipolar type as shown in FIG. 11, it is preferred that a first groove 69 be formed on the upper surface of the base 1 between the bent portions 53 of the second fixed contact segments 46*a*,46*b* and that a second groove 70 be formed on the lower surface of the insulating member 3 so as to be positioned opposite the first groove 69. This feature enables to provide a sufficient spacing for isolation as a creaping distance between the oppositely facing edges of the bent portions 53 when the base 1 is made narrower. Such a sufficient spacing can also be provided by forming a ridge instead of one of the grooves 69 and 70 for engagement with the other groove.

While the sealing structure of the invention is applied to an electromagnetic relay in the above embodiment, the sealing structure is applicable to other electric devices such as a switch or a switching circuit.

What is claimed is:

1. An electric device including a casing structure for sealing the electric device, the casing structure comprising a base used for mounting internal components of the device and a casing, wherein the casing is formed with a recess extending toward an internal space of the casing, and wherein the casing as molded includes at a bottom of the recess a gate portion which is a mark of a molding inlet formed on the casing when the casing is molded, a bleeder portion for evacuation during a sealing operation and a vent portion for providing ventilation of the device.

2. The electric device according to claim 1, wherein the electric device comprises an electromagnetic relay having internal components including an electromagnet portion comprising a coil wound around an iron core with an intervening spool and a yoke integrated therein, an armature disposed on one side of the electromagnet portion, a movable contact segment and a fixed contact segment disposed on the other side, and a card disposed above the electromagnet portion for transmitting the rotation of the armature to the movable contact segment, the card being shaped as a substantially rectangular frame to define the internal space into which the recess can be accommodated.

* * * * *